US008904981B2

(12) United States Patent
Fiveland

(10) Patent No.: US 8,904,981 B2
(45) Date of Patent: Dec. 9, 2014

(54) ALTERNATING SPLIT CYCLE COMBUSTION ENGINE AND METHOD

(75) Inventor: Scott B. Fiveland, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/466,617

(22) Filed: May 8, 2012

(65) Prior Publication Data

US 2013/0298888 A1 Nov. 14, 2013

(51) Int. Cl.
*F01L 1/26* (2006.01)

(52) U.S. Cl.
USPC ..... 123/90.23; 123/70 R; 123/90.16; 123/90.21

(58) Field of Classification Search
USPC ... 123/70 R, 65 R, 68, 71 R, 27 R, 42, 90.16, 123/90.17, 90.18, 90.23, 90.21; 60/605.1, 60/39.6
See application file for complete search history.

(56) References Cited

U.S. PATENT DOCUMENTS

| | | | | |
|---|---|---|---|---|
| 6,216,667 | B1 * | 4/2001 | Pekar | 123/320 |
| 6,508,233 | B1 * | 1/2003 | Suhre et al. | 123/478 |
| 6,543,225 | B2 | 4/2003 | Scuderi | |
| 6,609,371 | B2 | 8/2003 | Scuderi | |
| 6,722,127 | B2 | 4/2004 | Scuderi et al. | |
| 6,880,502 | B2 | 4/2005 | Scuderi | |
| 6,952,923 | B2 | 10/2005 | Branyon et al. | |
| 6,983,732 | B2 * | 1/2006 | Kuo et al. | 123/299 |
| 6,986,329 | B2 | 1/2006 | Scuderi et al. | |
| 7,004,115 | B2 * | 2/2006 | Patton | 123/25 C |
| 7,017,536 | B2 | 3/2006 | Scuderi | |
| 7,121,236 | B2 | 10/2006 | Scuderi et al. | |
| 7,201,156 | B1 * | 4/2007 | Wait | 123/556 |
| 7,353,786 | B2 | 4/2008 | Scuderi et al. | |
| 7,481,190 | B2 | 1/2009 | Scuderi | |
| 7,513,224 | B2 | 4/2009 | Heaton | |
| 7,536,984 | B2 | 5/2009 | Lou | |
| 7,571,699 | B2 | 8/2009 | Forner, Sr. et al. | |
| 7,588,001 | B2 | 9/2009 | Branyon et al. | |

(Continued)

FOREIGN PATENT DOCUMENTS

WO WO 2011/045642 4/2011

OTHER PUBLICATIONS

Coney et al., "A Novel Internal Combustion Engine with Simultaneous Injection of Fuel and Pre-Compressed Pre-Heated Air," ASME Paper No. ICEF 2002-485, ICE vol. 39, pp. 67-77.

(Continued)

*Primary Examiner* — Noah Kamen
*Assistant Examiner* — Long T Tran
(74) *Attorney, Agent, or Firm* — Leydig, Voit & Mayer, Ltd.

(57) ABSTRACT

An internal combustion engine includes a cylinder that is connectable to an intake manifold through an intake valve, to an exhaust manifold through an exhaust valve, and to a transfer manifold through transfer and combustion valves. A fuel injector associated with the cylinder is adapted to provide fuel to the cylinder. During operation, the cylinder performs an intake stroke, followed by a compression stroke. A compressed charge from the cylinder passes to and is collected in the transfer manifold through the transfer valve. The cylinder is filled by a compressed charge from the transfer manifold through the combustion valve at the same time as the fuel injector provides fuel. The cylinder then undergoes combustion and exhaust strokes. In this way, cylinder operation alternates between combustor and compressor split combustion modes.

22 Claims, 6 Drawing Sheets

(56) References Cited

U.S. PATENT DOCUMENTS

| | | | | |
|---|---|---|---|---|
| 7,603,970 | B2 | 10/2009 | Scuderi et al. | |
| 7,628,126 | B2 | 12/2009 | Scuderi | |
| 7,637,234 | B2 | 12/2009 | Tussing et al. | |
| 7,690,337 | B2 | 4/2010 | Pirault et al. | |
| 7,810,459 | B2 | 10/2010 | Branyon et al. | |
| 7,823,547 | B2 | 11/2010 | Forner, Sr. et al. | |
| 7,954,461 | B2 | 6/2011 | Branyon et al. | |
| 7,954,462 | B2 | 6/2011 | Scuderi et al. | |
| 7,954,463 | B2 * | 6/2011 | Branyon et al. | 123/68 |
| 7,963,259 | B2 | 6/2011 | Meldolesi et al. | |
| 8,006,656 | B2 | 8/2011 | Branyon et al. | |
| 8,256,390 | B1 * | 9/2012 | Bonner | 123/64 |
| 2005/0000485 | A1 * | 1/2005 | Kuo et al. | 123/299 |
| 2005/0115547 | A1 * | 6/2005 | Bryant | 123/559.1 |
| 2005/0126522 | A1 * | 6/2005 | Ruggiero | 123/90.12 |
| 2007/0157894 | A1 * | 7/2007 | Scuderi et al. | 123/70 R |
| 2008/0201058 | A1 * | 8/2008 | Bryant | 701/103 |
| 2009/0235881 | A1 * | 9/2009 | Bonner | 123/64 |
| 2009/0272368 | A1 * | 11/2009 | Branyon et al. | 123/70 R |
| 2010/0229806 | A1 * | 9/2010 | Kemeny | 123/2 |
| 2010/0275878 | A1 * | 11/2010 | Phillips | 123/299 |
| 2012/0167566 | A1 * | 7/2012 | Gentili et al. | 60/605.1 |
| 2012/0192841 | A1 * | 8/2012 | Meldolesi et al. | 123/70 R |

OTHER PUBLICATIONS

Gronlund et al., "Valve Train Design for a New Gas Exchange Process," SAE International 2004-01-0607, 13 pp. (2004).

Musu et al., "CFD Study of HCPC Turbocharged Engine," SAE International 2010-00-2107, 12 pp. (Oct. 25, 2010).

Musu et al., "Clean Diesel Combustion by Means of the HCPC Concept," *SAE Int. J. Engines*, vol. 3:1, Apr. 12, 2010, pp. 964-981.

Musu et al., "Homogeneous Charge Progressive Combustion (HCPC) CFD Study of an Innovative Diesel HCCI Concept," SAE International 2009-01-1344, 14 pp. (2009).

Musu et al., "Improvements in Efficiency and Mixture Formation for an Innovative Diesel HCCI Concept," ASME Paper No. ICEF 2002-485, ASME 2009 Tech. Conf., Sep. 20-24, 2009, pp. 181-190.

Tamagna et al., "A Preliminary Study Towards an Innovative Diesel HCCI Combustion," ASME Paper No. ICEF 2007-1743, *ASME 2009 Tech. Conf.*, Oct. 14-17, 2007, pp. 329-341.

Tiainen et al., "Novel Two-Stroke Engine Concept, Feasibility Study," SAE International 2003-01-3211, 15 pp. (2003).

"New Split-Cycle Concept to Control Diesel HCCI Combustion," Green Car Congress, Oct. 25, 2010, downloaded from http://www.greencarcongress.com/2010/10/hcpc-20101025.html.

Int'l Search Report for WO2011/045642, 3 pp., Jun. 15, 2011.

* cited by examiner

ALTERNATING SPLIT CYCLE COMBUSTION ENGINE AND METHOD

TECHNICAL FIELD

This patent disclosure relates generally to internal combustion engines and, more particularly, to split-combustion engines.

BACKGROUND

Split combustion in internal combustion engines of various types is known. In a typical split combustion engine, the intake and compression strokes or phases are performed in one engine cylinder, commonly referred to as the compressor, and the combustion and exhaust strokes or phases are performed in a second engine cylinder, which is commonly referred to as the combustor. The compressed air charge from the compressor is transferred to the combustor via a transfer duct. As can be appreciated, the compressed air charge is at a high pressure and typically travels through the transfer duct at supersonic speeds.

In a typical split combustion engine, combustion fuel is added to the compressed air charge either in the transfer duct or directly into the combustor. Typically, a transfer valve is positioned between the compressor cylinder and the transfer duct. The compressor piston has a phased crank-angle delay relative to the combustor cylinder, and the combustion occurs after the combustor cylinder has reached top dead center (TDC). In this way, the combustor piston can begin to move downwards while the compressor piston is still moving upwards to ensure that the combusting mixture of fuel and air in the combustor cylinder does not recirculate back into the compressor cylinder.

As can be appreciated, typical split combustion engines involve two engine cylinders in compressor/combustor pairs. Thus, an engine having an even number of cylinders will typically operate such that half of the engine's cylinders are operating as compressors, while the other half are operating as combustors, where each compressor is paired with a corresponding combustor. One drawback of typical split combustion engines is uneven heat distribution in the engine block that results from half of the engine's cylinders undergoing combustion strokes twice per engine revolution, while the other half never undergo a combustion stroke. This uneven heat distribution can cause thermal issues for all engine components involved, as well as drive different design parameters for each cylinder type and for the crankcase, which ultimately leads to increased engine complexity, additional and specialized components and development costs.

SUMMARY

The disclosure describes, in one aspect, an internal combustion engine. The engine includes a cylinder case forming a cylinder bore, which has a piston reciprocally disposed therewithin that is moveable between top dead center (TDC) and bottom dead center (BDC) positions. The piston is connected to a rotatable crankshaft such that a position of the piston within the cylinder bore is related to a crank shaft angle. A cylinder head is disposed to cover an open end of the cylinder bore and defines one end of a variable volume within the cylinder bore between the cylinder head and the piston. An intake manifold is fluidly connectable with the variable volume through an intake valve, and an exhaust manifold is fluidly connectable with the variable volume through an exhaust valve.

In one disclosed embodiment, a transfer manifold is fluidly connectable with the variable volume via a transfer duct through a transfer valve, and is further fluidly connectable with the variable volume via a combustion conduit through a combustion valve. A fuel injector is associated with the variable volume and adapted to provide a predetermined amount of fuel into the variable volume. A valve activation mechanism is configured to selectively open and close each of the intake, exhaust, transfer and combustion valves, such that: the intake valve opens when the piston undergoes an intake stroke as it moves from the TDC position towards the BDC position to fill the variable volume with fluid from the intake manifold, the variable volume is closed when the piston undergoes a compression stroke as it moves from the BDC position towards the TDC position to compress fluid present therein and yield a compressed charge, the transfer valve opens to provide the compressed charge to the transfer manifold, where the compressed charge is collected, the combustion valve opens to admit a compressed charge from the transfer manifold into the variable volume, the variable volume is closed when the piston undergoes a combustion stroke as it moves from the TDC position towards the BDC position to combust a fluid/air mixture present therein, and the exhaust valve opens when the piston undergoes an exhaust stroke as it moves from the BDC position towards the TDC position to evacuate the variable volume from at least a portion of exhaust gas that is present therein.

In another aspect, the disclosure describes an internal combustion engine having first and second pluralities of cylinders. The engine includes a cylinder case forming first and second pluralities of cylinder bores. Each cylinder bore has a piston reciprocally disposed therewithin and moveable between top dead center (TDC) and bottom dead center (BDC) positions. Each piston is connected to a rotatable crankshaft such that a position of each piston within a respective cylinder bore is related to a crank shaft angle. A cylinder head is disposed to cover an open end of the cylinder bores such that first and second pluralities of variable volumes are defined within each respective cylinder bore between the cylinder head and the respective piston. An intake manifold is fluidly connectable with the first and second pluralities of variable volumes through a respective intake valve associated with each variable volume, and an exhaust manifold is fluidly connectable with the first and second pluralities of variable volumes through a respective exhaust valve associated with each variable volume.

In one disclosed embodiment, a first transfer manifold is fluidly connectable with the first plurality of variable volumes via a respective transfer conduit and a respective transfer valve, and is further fluidly connectable with the second plurality of variable volumes via a respective combustion conduit and a respective combustion valve. A second transfer manifold is fluidly connectable with the second plurality of variable volumes via a respective transfer conduit and a respective transfer valve, and is further fluidly connectable with the first plurality of variable volumes via a respective combustion conduit and a respective combustion valve. A fuel injector is associated with each of the combustion conduits of the first and second pluralities of variable volumes, and is adapted to provide a predetermined amount of fuel into each variable volume. A valve activation mechanism is configured to selectively open and close each of the intake, exhaust, transfer and combustion valves, of each of the first and second pluralities of variable volumes, such that: the intake valve of one of the first plurality of variable volumes opens when the respective piston undergoes an intake stroke as it moves from the respective TDC position towards the BDC position to fill the one of the first plurality of variable volumes with fluid from the intake manifold; the one of the first plurality of variable volumes is closed when the piston undergoes a compression stroke as it moves from the respective BDC position towards the TDC position to compress fluid present therein and yield a compressed charge; the transfer valve corresponding to the one of the first plurality of variable volumes opens to provide the compressed charge to the first transfer manifold, where the compressed charge is collected; the combustion valve corresponding to the one of the first plurality of variable volumes opens to admit a compressed charge from the second transfer manifold into the one of the first plurality of variable volumes; the one of the first plurality of variable volumes is closed when the respective piston undergoes a combustion stroke as it moves from the respective TDC position towards the BDC position to combust a fluid/air mixture present therein; and the exhaust valve corresponding to the one of the first plurality of variable volumes opens when the respective piston undergoes an exhaust stroke as it moves from the BDC position towards the TDC position to evacuate the one of the first plurality of variable volumes from at least a portion of exhaust gas that is present therein.

In yet another aspect, the disclosure describes a method for operating an internal combustion engine. The method includes at least partially opening an intake valve during an intake stroke of a cylinder, the cylinder defining a variable volume as a piston moves from a top dead center (TDC) position towards a bottom dead center (BDC) position. The intake valve is closed to fluidly isolate an air charge within the variable volume, and a compression stroke is performed, during which the piston moves from the BDC position towards the TDC position, such that the air charge becomes a compressed air charge. A transfer valve is at least partially opened at a predetermined piston position within the cylinder to release the compressed charge from the variable volume and into a transfer manifold, which collects one or more compressed air charges. A combustion valve is opened to admit a compressed charge into the variable volume from the transfer manifold, and a predetermined amount of fuel is provided in mixing relation with the compressed charge entering the variable volume. The combustion valve is closed and a combustion stroke of the cylinder is performed. An exhaust stroke of the cylinder is then performed, during which an exhaust valve at least partially opens to release at least a portion of exhaust gas present in the variable volume into an exhaust manifold.

DETAILED DESCRIPTION

This disclosure relates to internal combustion engines configured to operate under an alternating split-cycle combustion arrangement. Accordingly, although the various operating strokes for combustion are split between different engine cylinders, each engine cylinder is configured to selectively operate either as a compressor cylinder or as a combustion cylinder. In this way, engine operation is flexible and heat loading of the engine is distributed across all engine cylinders. Three main embodiments are presented herein for engines configured for split combustion operation. In a first embodiment, an engine 100 (FIG. 1) includes a single high-pressure combustion air manifold shared by a group of engine cylinders, each of which includes a transfer valve for exchanging high pressure air charge between the charge air manifold and the respective cylinder. In a second embodiment, an engine 400 (FIG. 2) includes a transfer valve for providing charge air to the high-pressure manifold and a combustion valve disposed in a passage that further includes a fuel injector. In a third embodiment, an engine 500 (FIG. 3) includes segmented transfer manifolds for providing charged air to subsets of engine's cylinders. These three embodiments and a mode of engine operation are described in further detail below.

Figure 1:
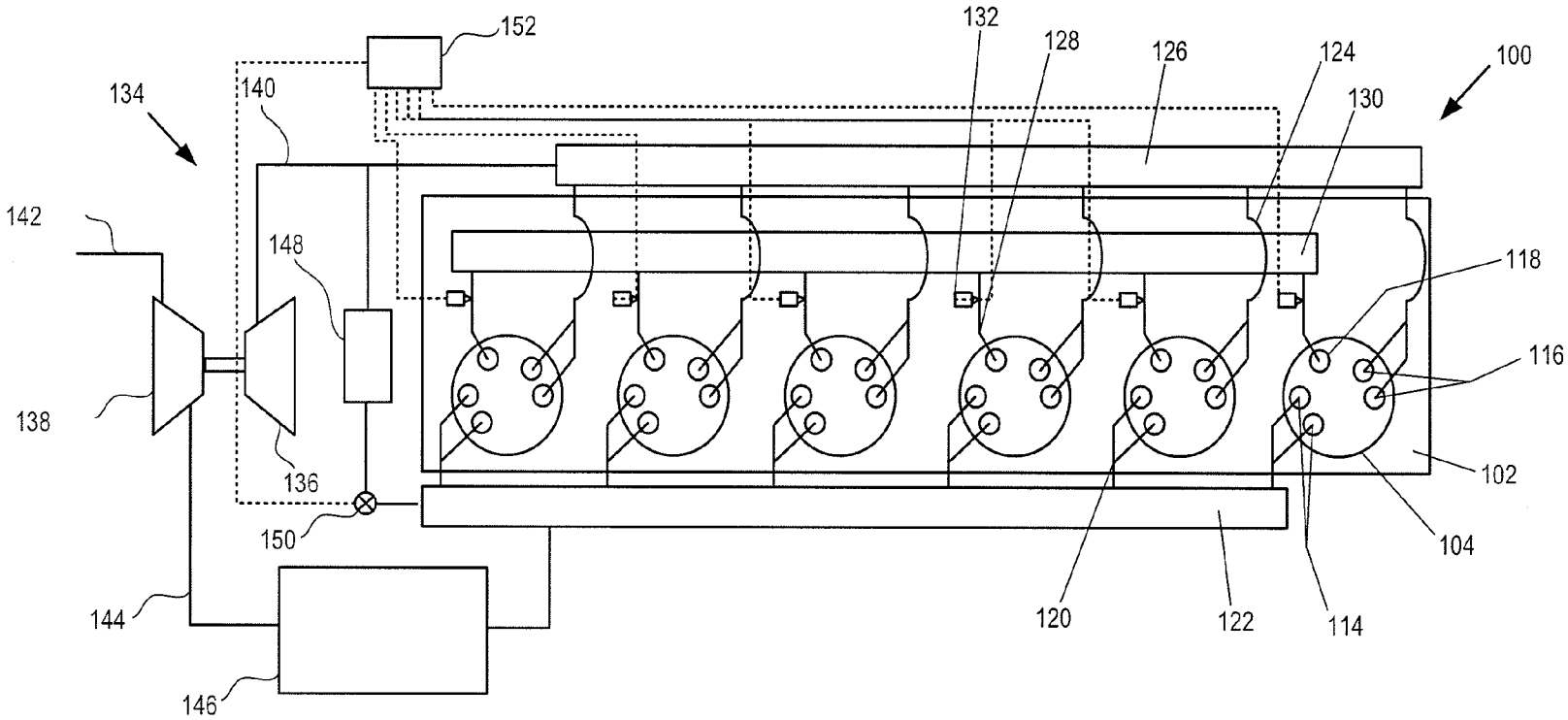
FIG. 1 is a block diagram of an engine in accordance with the disclosure.
Figure 4:
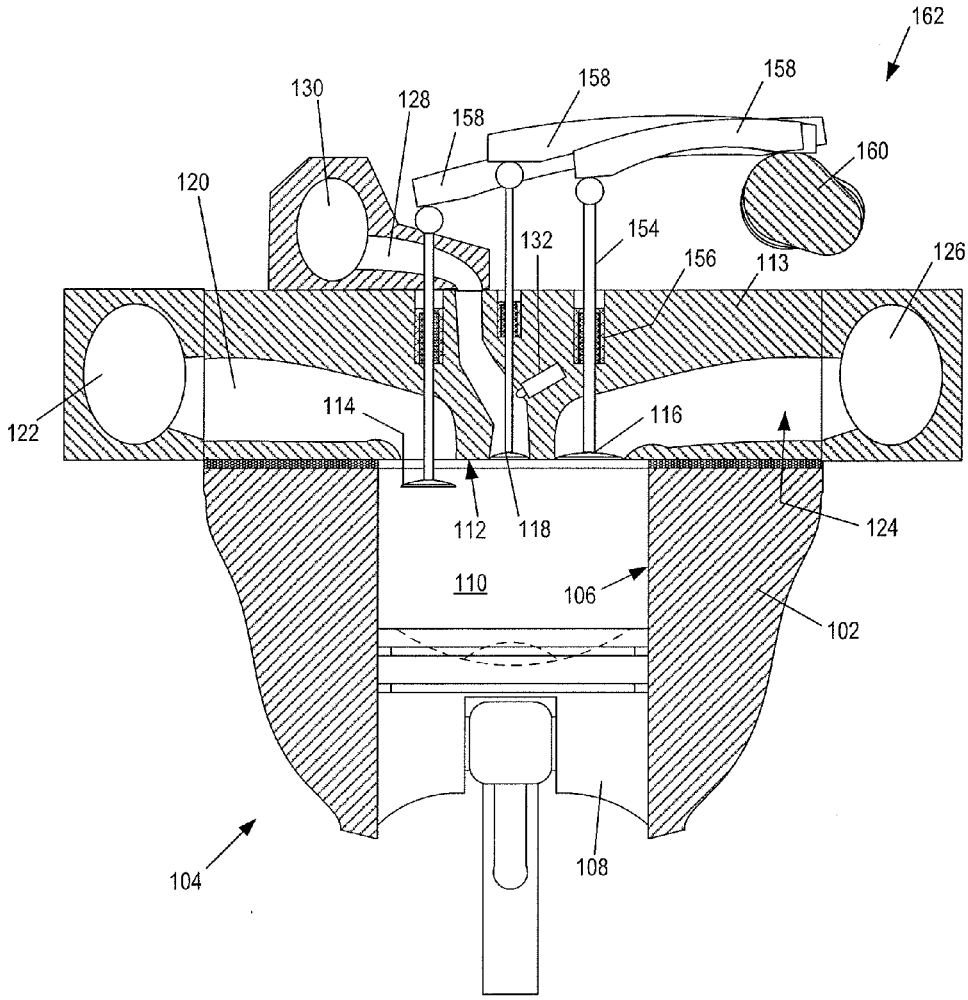
FIG. 4 is a cross section of an alternating combustion engine cylinder in accordance with the disclosure.

A block diagram for the engine 100 is shown in FIG. 1. The engine 100 includes a crankcase 102 that forms a plurality of engine cylinders 104. In the illustrated embodiment, the engine 100 includes six cylinders 104 arranged in an inline configuration but any other number of cylinders may be used, including a single cylinder, as well as any other cylinder configuration, such as a V-configuration. As is best shown in FIG. 4, each cylinder 104 includes a bore 106 slidably accepting therewithin a piston 108. As is known from typical engine applications, pistons can be connected to an engine crankshaft (not shown), which operates to provide a force tending to move each piston within the cylinder bore, for example, during a compression stroke, as well as can be moved by a force applied by the piston to rotate the crankshaft, for example, during a combustion or power stroke.

The cylinder 104 defines a variable volume 110 that, in the illustrated orientation, is laterally bound by the walls of the bore 106 and is closed at its ends by a top portion or crown of the piston 108 and by a surface 112 of the cylinder head 113, which is typically referred to as the flame deck. The variable volume 110 changes between maximum and minimum capacity as the piston 108 reciprocates within the bore 106 between bottom dead center (BDC) and top dead center (TDC) positions, respectively.

In reference to FIG. 1, each cylinder 104 includes at least one intake valve 114 (two shown) and at least one exhaust valve 116 (two shown). In the illustrated embodiment of FIG. 1, the cylinder 104 further includes a transfer valve 118. The intake, exhaust and transfer valves 114, 116 and 118 are selectively activated to fluidly connect the variable volume 110 with sinks and sources of fluids during operation of the engine 100. Specifically, the intake valve 114 selectively blocks an intake passage 120 that fluidly interconnects the variable volume 110 with an intake manifold 122. Similarly, the exhaust valve 116 selectively blocks an exhaust passage 124 that fluidly interconnects the variable volume 110 with an exhaust manifold 126. The transfer valve 118 in the embodiment illustrated selectively fluidly blocks a transfer passage 128 that fluidly interconnects the variable volume 110 with a transfer manifold 130. In the embodiment of FIG. 1, each of the engine cylinders 104 is connected to the intake, exhaust and transfer manifolds 122, 126 and 130 via corresponding intake, exhaust and transfer valves 114, 116 and 118. A fuel injector 132 is disposed to inject fuel within the transfer passage 128 of each cylinder 104 of the engine 100.

Apart from the transfer manifold 130 and the fluid interconnections of the engine cylinders 104 therewith, the engine 100 can otherwise have any appropriate air system configuration. In the exemplary embodiment of the engine 100 shown in FIG. 1, the engine 100 includes a turbocharger 134 having a turbine 136 connected to a compressor 138, but other configurations, such as multi-staged, series or parallel turbocharger configurations may be used. During operation of the engine 100, exhaust gas collected in the exhaust manifold 126 is provided to drive the turbine 136, in a known fashion, through an exhaust conduit 140. Exhaust conduit and after-treatment components disposed downstream of the turbine 136 are not shown in FIG. 1 for simplicity, but any appropriate configuration may be used.

The turbine 136 drives the compressor 138, which compresses filtered, ambient air from an intake duct 142 to provide compressed, charge air to an air conduit 144. The air conduit 144 includes an optional charge air cooler (CAC) cooler 146, which cools the charge air before it is provided to the intake manifold 122. The illustrated engine 100 further includes a high pressure loop (HPL) exhaust gas recirculation (EGR) system, but other types of EGR systems such as low or intermediate pressure systems may be used. Depending the requirements of the specific engine application, the EGR system may be omitted entirely. In the illustrated embodiment, the EGR system includes an EGR cooler 148 that fluidly interconnects the exhaust manifold 126 with the intake manifold 122 such that cooled exhaust gas can be provided to the intake of the engine. An EGR valve 150 is disposed to meter the amount of exhaust gas recirculated in this fashion.

The engine 100 further includes an electronic controller 152. The electronic controller 152 may be a single controller or may include more than one controller disposed to control various functions and/or features of the engine 100 and/or features of a vehicle or machine in which the engine 100 is installed. For example, a master controller, used to control the overall operation and function of a machine, may be cooperatively implemented with a motor or engine controller used to control the engine 100. In this embodiment, the term "controller" is meant to include one, two, or more controllers that may be associated with the engine 100 and that may cooperate in controlling various functions and operations of the engine 100 (FIG. 1), or any other embodiments for engines described hereinafter. The functionality of the controller, while described conceptually in the present disclosure to include various discrete functions for illustrative purposes only, may be implemented in hardware and/or software without regard to the discrete functionality shown. Accordingly, various interfaces of the controller are described relative to components of the engine 100 shown in FIG. 1, but such interfaces are not intended to limit the type and number of components that are connected, nor the number of controllers that are described.

Accordingly, the controller 152 is associated with each of the fuel injectors 132 and the EGR valve 150 and configured to selectively control their operation. The controller 152 is further associated with sensors and actuators of the engine such as crankshaft and/or camshaft position sensors (not shown), engine speed and/or torque sensors (not shown), and other known sensors and actuators that participate in providing functions and information to the controller 152 to control and monitor engine operation.

Figure 5:
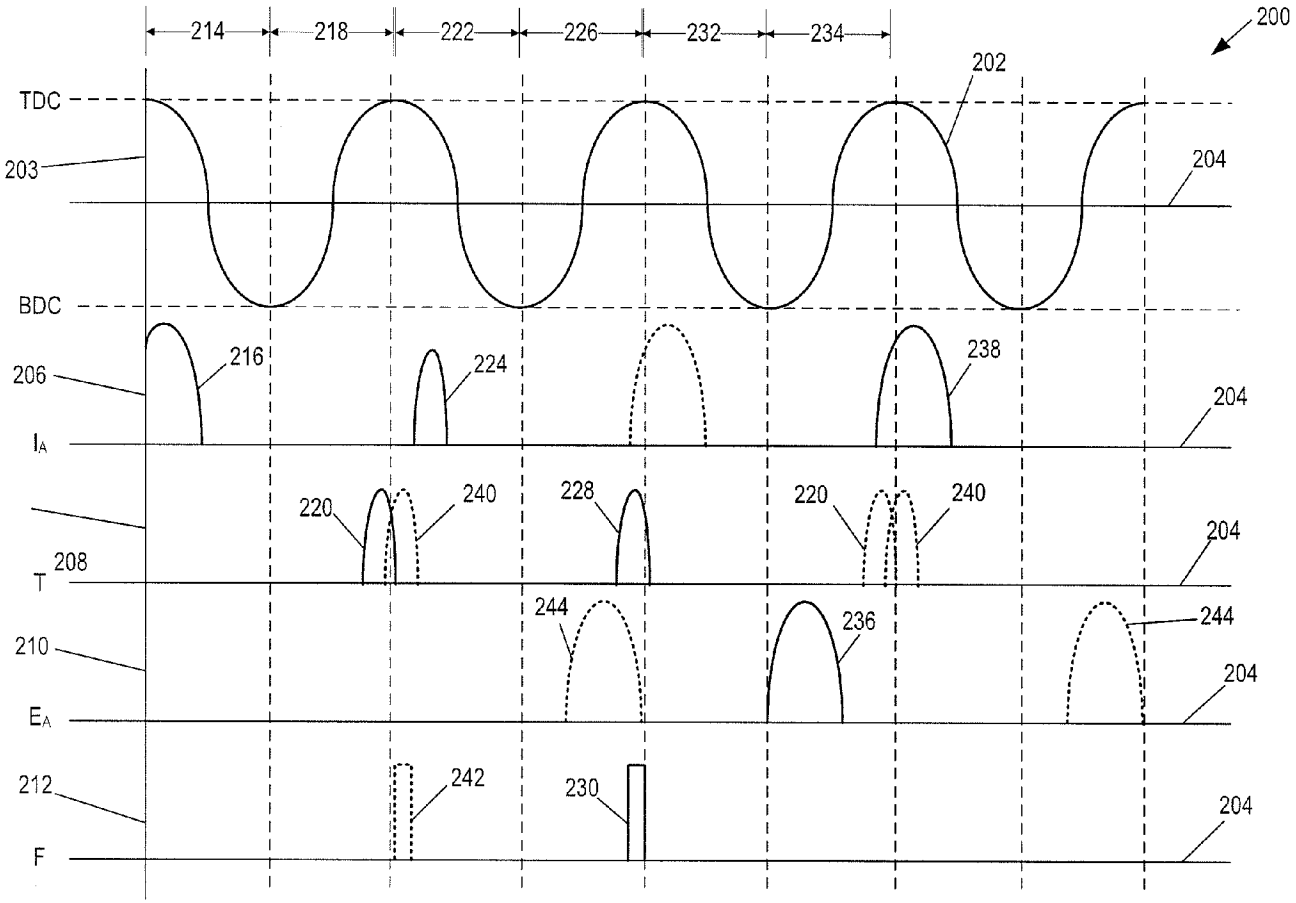
FIG. 5 is a collection of time-aligned charts of piston position, valve opening, and fuel injection timing for an alternating split-combustion engine in accordance with the disclosure.

The engine 100 advantageously operates in an alternating split combustion mode, thus overcoming the drawbacks of typical split combustion engine cycles. Specifically, where particular cylinders in typical split combustion engines consistently operate either as compressor or combustor cylinders, each of the cylinders 104 of the engine 100 is configured to selectively operate at times either as a compressor or as a combustor cylinder. In this way, heat may be distributed relatively evenly across the crankcase 102, cylinder head 113, or any other heavy metal engine structures. The alternating split combustion mode of operation of each cylinder 104 is accomplished by the activation at specific periods of the intake, exhaust and transfer valves 114, 116 and 118 (FIG. 1), as well as the activation of the fuel injector 132 at predetermined times and for predetermined periods to provide a predetermined amount of fuel within the transfer passage 128 while super-compressed air from the transfer manifold 130 passes into the variable volume 110 within the cylinder 104 through the opened transfer valve 118. A graph 200 illustrating various engine parameters during an alternating split combustion mode of operation is shown in FIG. 5.

Graph 200 illustrates a plurality of engine parameters in time-aligned fashion for the sake of discussion. At the top, a first curve 202 illustrates a position of an engine piston within its corresponding bore, for example, the piston 108 that reciprocates within bore 106, plotted against a range of crankshaft angles. The piston position alternates between TDC and BDC positions, which are plotted along the vertical axis 203, and, when piston position is plotted against crankshaft angles 204, which are illustrated in the horizontal axis, produces a generally sinusoidal curve. The alternating split combustion cycle of each piston in the illustrated embodiment repeats continuously during engine operation such that each piston alternates between operation as a compressor cylinder and as a combustor cylinder.

To illustrate one embodiment for accomplishing this alternating split cycle combustion, the various strokes of operation are described relative to the operation of the various valves and fuel injector(s) that are associated with each cylinder. The operation of the cylinder as a compressor is described first, but it should be appreciated that each cylinder continuously operates in alternating fashion as either a combustor or a compressor cylinder. Further, the operation of the engine 100 (FIG. 1) is denoted by solid lines in the graph 200.

The first curve 202 represents the position of the piston within the bore. The position of the intake valve(s) 206, for example, the intake valve 114 (FIG. 4), the position of the transfer valve 208, for example, the transfer valve 118 (FIG. 4), the position of the exhaust valve(s) 210, for example, the exhaust valve 116 (FIG. 4), and the activation of a fuel injector 212, for example, the fuel injector 132 (FIG. 4), are plotted with respect to crankcase angle in the graph 200.

In more particular reference to the graph 200, each cylinder undergoes an intake stroke over a range of crankshaft angles 214. During this time, the piston moves within the bore from a TDC position a BDC position within the bore, thus increasing the volume of the cylinder. Also during this time, an intake valve opens, as shown by curve 216, to admit air or a fluid mixture of air and exhaust gas from the intake manifold to fill the expanding cylinder volume. The degree and duration of opening of the intake valve can vary, for example, in accordance with a Miller cycle of operation, and thus the mass of fluid entering the cylinder can be controlled.

Having admitted a fluid or mixture of fluids into the cylinder, the cylinder undergoes a compression stroke over a range of crankshaft angles 218. During this time, the piston moves from the BDC position towards the TDC position such that the fluid present within the cylinder, which is maintained in a closed condition, can be compressed. Towards the end of the compression stroke, for example, before the piston has reached the TDC position and while the fluid within the cylinder is in a compressed state in the absence of fuel or other combustible agents, the transfer valve may open, as shown by curve 220, to release the compressed fluid into a transfer manifold, for example, the transfer manifold 130 (FIG. 4). This compressed fluid can pass at least partially into another engine cylinder that is about to undergo a combustion stroke. At this point, depending on the capacity of the transfer manifold, the compressed fluid may be directed into a cylinder ready to begin an combustion stroke directly, if the transfer manifold has a relatively small capacity such that it acts as a transfer passage for compressed fluid, or the compressed fluid may alternatively be collected into the transfer manifold and stored therein until a cylinder is ready to undergo a combustion stroke.

Turning now back to the graph 200, the solid-line curves illustrate the operating condition in which the transfer manifold acts as a passage for compressed fluid. In this condition, the piston reaches the TDC position as the transfer valve closes, and a second intake stroke is carried out over a range of crankshaft angles 222. During the second intake stroke, the intake valve may open at least momentarily, as shown by curve 224, to admit sufficient air into the cylinder to allow for an expansion of the cylinder volume without producing a negative pressure therein that may increase the parasitic load of the engine. As can be appreciated, the opening of the intake valve during this second intake stroke is optional and may be omitted in favor of retaining a small amount of air from the previous compression stroke, which was retained in the cylinder by early closing of the transfer valve before the total amount of fluid in the cylinder was expelled.

In the illustrated embodiment, the intake valve is opened during the second intake stroke 222 after the piston has reached the TDC position. After the piston reaches the BDC position at the end of the second intake stroke 222, it begins to once again move towards the TDC position while the cylinder undergoes a second compression stroke over a range of crankcase angles 226. During this time, an insignificant amount of air or other fluids is present in the cylinder because the mass present in the cylinder at this time will not be relied upon to provide the oxygen for the subsequent combustion stroke. Rather, the piston is moved close to the TDC position in preparation of receiving a compressed air charge in the cylinder. At this time, while the role of the cylinder thus far has been that of a compressor cylinder in a split combustion arrangement, the role of the cylinder changes to that of a combustor cylinder. The two cylinder strokes over crank angle ranges 222 and 226 can be referred to as "dead" strokes because they do not contribute to the positive power output of the engine.

As the piston approaches the TDC position during the second compression stroke 226, the transfer valve once again opens, as shown by curve 228. Unlike the previous opening of the transfer valve to remove compressed fluid from the cylinder, this time the opening of the transfer valve is for admitting a super-compressed air or mixture into the cylinder before the piston has reached the TDC position. The compressed charge admitted into the cylinder at this time is a charge that was compressed by a different engine cylinder and removed therefrom during a period 218 for that cylinder.

As the compressed charge enters the cylinder, for example, through a transfer passage having a fuel injector associated therewith, such as the transfer passage 128 having injector 132 therein (see FIG. 4), the fuel injector is activated as shown by curve 230. In this way, now present in the cylinder is a compressed air/fuel mixture, which combusts and causes the cylinder to expand during a combustion or power stroke occurring over a range of crankcase angles 232.

At the end of the power stroke 232, the piston reaches the BDC position and begins to move back towards TDC position while the cylinder undergoes an exhaust stroke over a range of crankshaft angles 234. During the exhaust stroke 234, the exhaust valve opens as shown by curve 236 to allow exhaust gas to evacuate the contracting cylinder volume. In the illustrated embodiment, the exhaust valve is closed early such that at least some exhaust gas is pushed out into the intake manifold as the intake valve opens again early, as shown by curve 238, in preparation of initiation of the first intake stroke of the cycle, which corresponds to the intake stroke 214 previously described. In this way, the alternating split cycle repeats in each of the engine cylinders where each cylinder alternates between a compressor mode and a combustor mode.

As an alternative to having dead strokes, the capacity of the transfer manifold can be increased such that high pressure fluids may be collected and stored therein during engine operation. The compressed fluids collected and stored within the transfer manifold may be used to immediately supply fluids to engine cylinders for initiating a combustion stroke immediately after the compression stroke 218 and thus avoid having dead strokes. The valve events associated with this type of operation are shown in dashed-line curves in graph 200.

Accordingly, once the cylinder has completed the compression stroke 218 as previously discussed, the piston reaches the TDC position. Immediately or shortly thereafter, the transfer valve opens once more, as shown by curve 240 to admit an amount of compressed fluids into the cylinder. At the same time, the fuel injector is activated as shown by curve 242 to supply the fuel that will mix with the incoming air charge into the cylinder to create conditions favorable for combustion. In this operating condition, the range of crank angles 222 for cylinder expansion represents a combustion stroke, and the range 226 that follows, which represents the motion of the cylinder back towards TDC, represents and exhaust stroke and the exhaust valve opens to release spent gases to the exhaust manifold, as shown by curve 244. After the exhaust stroke 226 is completed, operation of the cylinder repeats with the subsequent intake stroke, similar to stroke 214 previously described.

In one embodiment of an engine having a plurality of cylinders, such as the engine 100 (FIG. 1), the operation and duration of intake valve openings can be adjusted based on engine load such that excess compressed charge can be provided to the transfer manifold and stored therein for ensuring that a sufficient supply of charge is present and stored in the transfer manifold for supply to the engine cylinders.

Activation of the various valves of each cylinder can be accomplished in any appropriate fashion including using dedicated actuators selectively operating each valve, variable valve actuation systems, and other known methods. Such variable or selective valve activation systems may provide added flexibility in the operation of the engine where various Miller effects and/or control of the combustion or compression operating mode of each cylinder can be determined for each crankshaft revolution. For example, at low engine power operating modes, certain combustor mode events for certain cylinders may be skipped in favor of additional compressor mode events at those cylinders, which can provide more fuel efficient engine operation.

In the embodiment illustrated in FIG. 5, valve activation is accomplished by a traditional cam-follower arrangement. More specifically, and as shown in FIG. 4, each of the intake, exhaust and transfer valves 114, 116 and 118 has a respective valve stem 154 that pushes the valve to open against a respective closing spring 156. Each valve stem 154 is pushed by a valve bridge 158 that follows a respective lobe 160 of a rotating camshaft 162 in the known fashion. The rate of rotation of the camshaft may depend on the particular mode of engine operation. For example, for engines that include the dead stroke, as described above relative to the graph 200 (FIG. 5), the camshaft may be operating at ⅙ or ⅓ of the speed of the crankshaft. Alternatively, engines having sufficient capacity in the transfer manifold to support operation without the dead strokes, the camshaft may operate at ¼ or ½ of the speed of the crankshaft.

Figure 2:
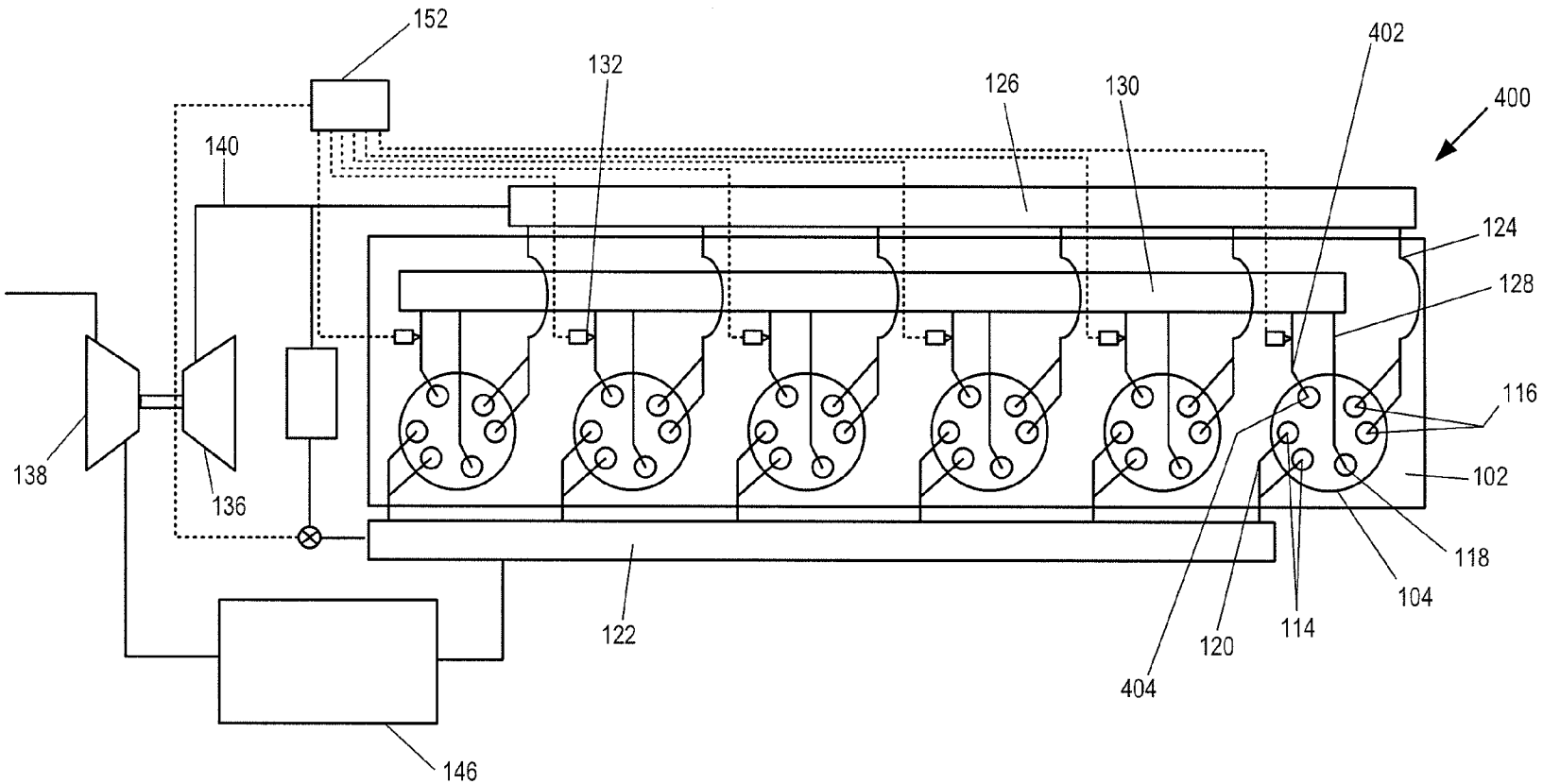
FIG. 2 is a block diagram of an alternative embodiment of an engine in accordance with the disclosure.
Figure 3:
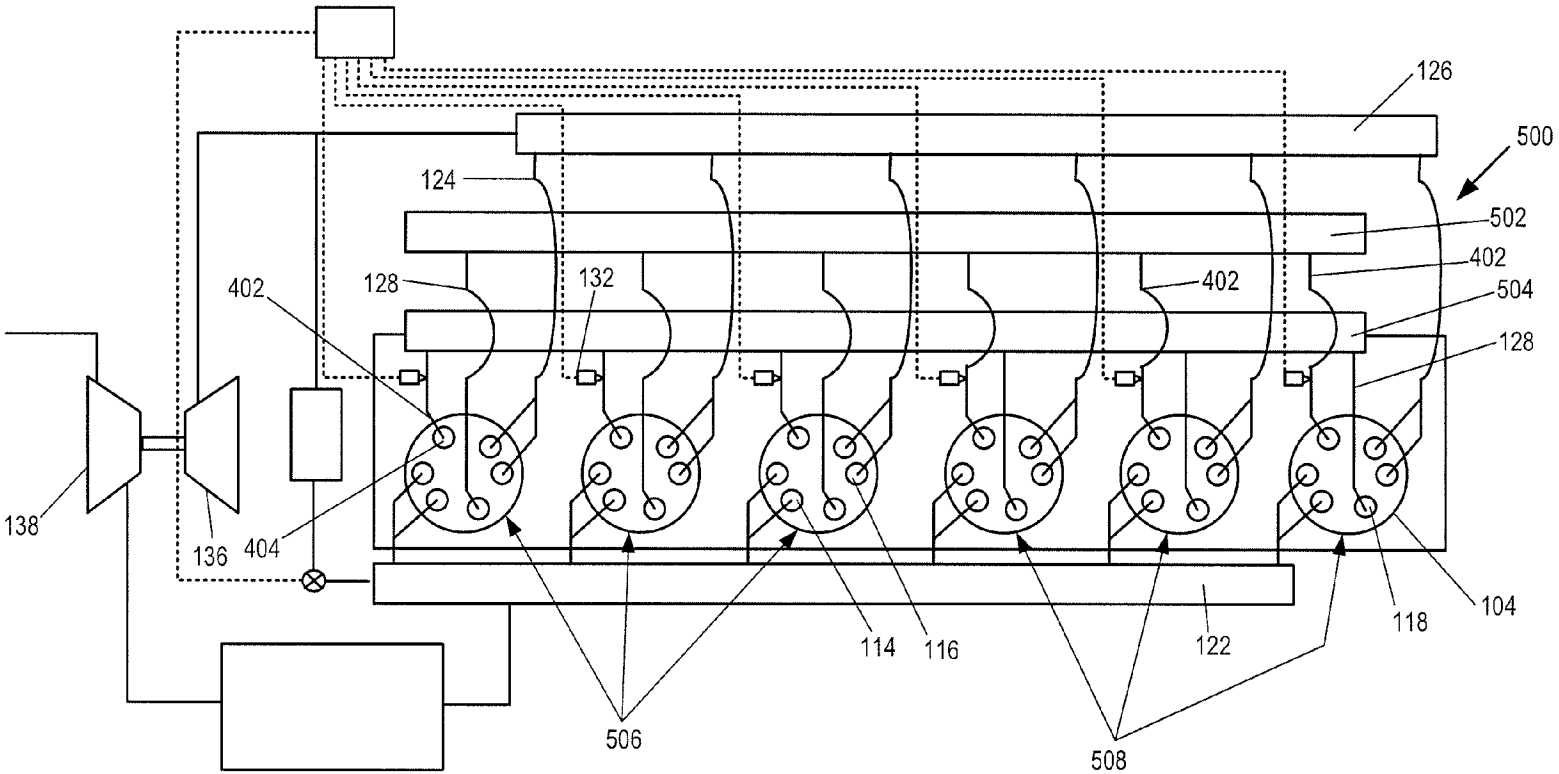
FIG. 3 is a block diagram of another alternative embodiment of an engine in accordance with the disclosure.

To address considerations relating to fast successive valve activations, for example, the successive activations of the transfer valve as shown by curves 220 and 240 in graph 200 (FIG. 5), and to lessen the effect of loss of flow momentum for the super-compressed air charge in the transfer manifold, two alternative engine embodiments, respectively identified as 400 and 500, are shown in FIGS. 2 and 3. In these figures, structures and/or features that are the same or similar to corresponding structures and features of the engine 100 are denoted by the same reference numerals as previously used for simplicity.

Accordingly, in reference to FIG. 2, each cylinder 104 of the engine 400 includes a transfer valve 118, which is connected to the transfer manifold 130 via the transfer passage 128, as previously described. In this illustration, however, the transfer valve 118 is shown in the lower portion of the cylinder 104. As can be seen, unlike the engine 100 (FIG. 1), the fuel injector 132 of each cylinder 104 in the engine 400 is not disposed in the transfer passage 128. This is because the flow paths in the engine 400 for compressed charge exiting the cylinder 104 and charge provided to the cylinder 104 have been separated. Accordingly, in the engine 400, a fluid charge is provided to the cylinder 104 via a combustion passage 402, which includes the fuel injector 132. The combustion passage 402 fluidly interconnects the transfer manifold 130 with the cylinder 104 via a combustion valve 404. In this way, high-pressure charge is provided to the transfer manifold 130 from each cylinder 104 when the transfer valve 118 is open but the combustion valve 404 is closed, and compressed air charge from the transfer manifold 130 enters the cylinder 104 when the transfer valve 118 is closed and the combustion valve 404 is open and while the fuel injector 132 disposed in the combustion passage 402 is activated. In other words, the two successive valve events illustrated by curves 220 and 240 can be separated such that, for example, event 220 can be carried out by transfer valve 118 (FIG. 2) and event 240 can be carried out by combustion valve 404 (FIG. 2), to enable more accurate control of the valve position. For example, each valve has sufficient time to completely open and close regardless of the position of the other valve during each fluid-transfer event between the transfer manifold and each cylinder.

Relative to the capacity of the transfer passage 130, and to minimize losses in flow momentum and effects of the enthalpy of the air charge being transferred between cylinders, an alternative embodiment for an engine 500 having first and second transfer manifolds 502 and 504 is shown in FIG. 3. In this embodiment, the engine cylinders 104 are divided into a first plurality of cylinders 506 and a second plurality of cylinders 508. Each cylinder 104 in the first and second pluralities of cylinders 506 and 508 includes intake and exhaust valves 114 and 116 that are connected to the intake and exhaust manifolds 122 and 126 as previously described. Further, each cylinder 104 includes a transfer valve 118 and a combustion valve 404, which operate relative to the respective cylinder in a fashion similar to that described relative to the engine 400 (FIG. 2). However, in this embodiment, the high pressure charge contributed by a cylinder operating as a compressor and belonging to one plurality of cylinders is directed to a cylinder operating as a combustor and belonging to a different plurality of cylinders.

More specifically, each transfer passage 128 of each of the cylinders 104 belonging to the first plurality of cylinders 506 is fluidly connected to the first transfer manifold 502. The first transfer manifold 502 is further fluidly connected to each combustion passage 402 of each of the cylinders 104 belonging to the second plurality of cylinders 508. Similarly, each transfer passage 128 of each of the cylinders 104 belonging to the second plurality of cylinders 508 is fluidly connected to the second transfer manifold 504, and each combustion passage 402 of each of the cylinders 104 belonging to the first plurality of cylinders 506 is connected to the second transfer manifold 504.

During operation, compressed charge provided by one of the first plurality of cylinders 506 operating in a compressor mode is collected in the first transfer manifold 502. From there, compressed charge is provided for combustion in one of the second plurality of cylinders 508. Similarly, compressed charge provided by one of the second plurality of cylinders 508 operating in compressor mode is collected in the second transfer manifold 502, from where it is provided to the first plurality of cylinders 506. By separating the two pluralities of cylinders 506 and 508 in this fashion, the volume of each of the first and second transfer manifolds 502 and 504 can be made smaller relative to the volume of a single transfer manifold 130 (FIGS. 1 and 2). By reducing transfer manifold volume, the compressed air charge undergoes less expansion and maintains more of its flow velocity and enthalpy during transfer between cylinders and/or while it collects in the transfer manifold, thus increasing engine efficiency. Moreover, separate transfer manifolds can help improve airflow control, especially in engines operating without a dead stroke, such that air leaving the cylinder through the respective transfer valve does not interfere with incoming air to the cylinder through the combustion valve.

It is noted that, although the engine 500 is shown having two pluralities of cylinders 506 and 508 and two transfer manifolds 502 and 504, more than two cylinder pluralities operating with more than two transfer manifolds may be used. Additionally, even though the cylinders in the first and second pluralities of cylinders are shown grouped together, they may be grouped in any other desired configuration, including having cylinders belonging in different pluralities being disposed in an alternating fashion within the cylinder case. Along these lines, different engine configurations, such as V-engines, may have cylinders grouped by cylinder banks or across cylinder banks, as desired.

INDUSTRIAL APPLICABILITY

Figure 6:
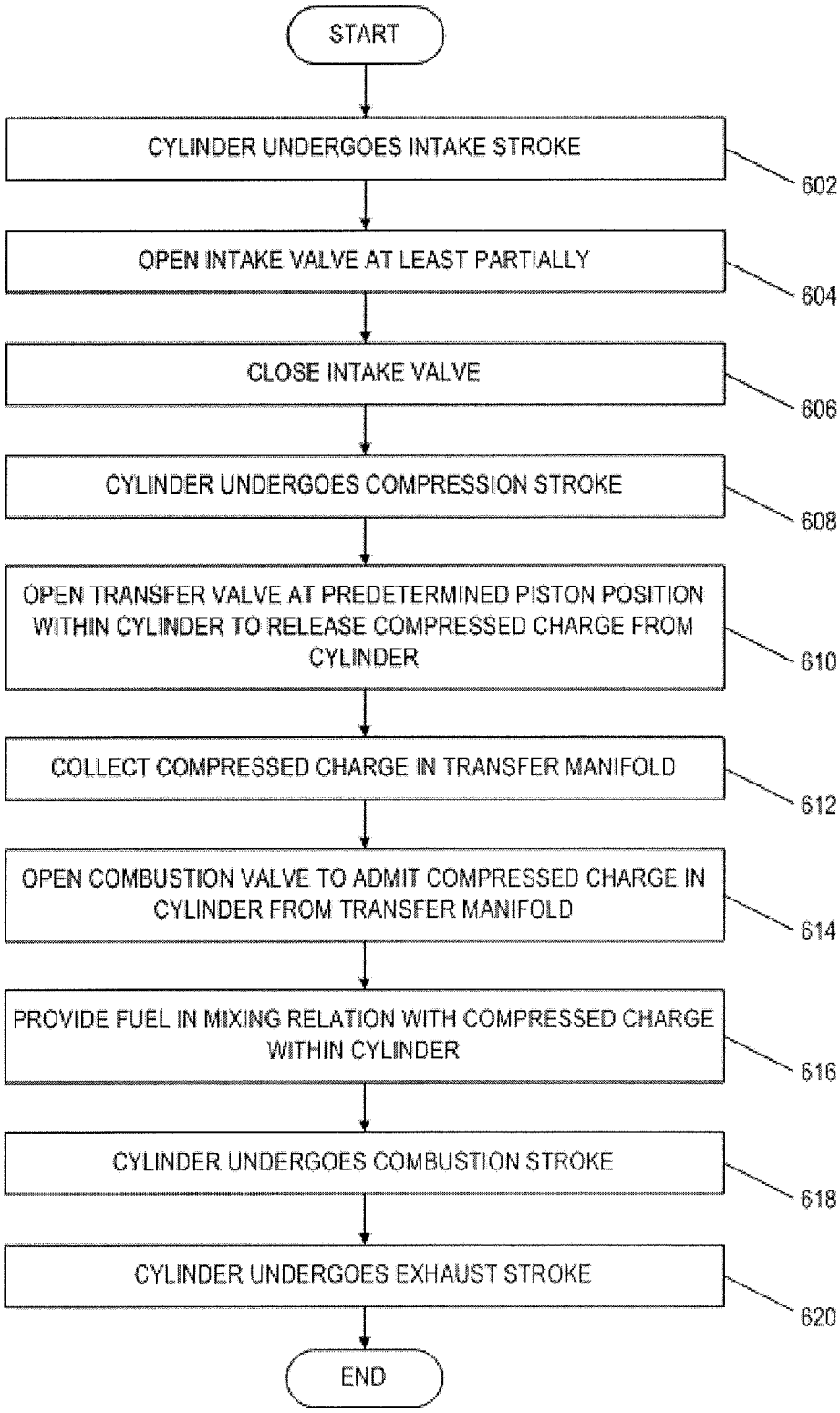
FIG. 6 is a flowchart for a method of operating an engine in accordance with the disclosure.

The present disclosure is applicable to split combustion engines. A flowchart for a method of operating an alternating split combustion engine is shown in FIG. 6. The method there described is applicable to one or more cylinders operating in an internal combustion engine, and may repeat indefinitely while the engine operates. Accordingly, a cylinder undergoes an intake stroke, during which a piston within the cylinder moves from a TDC position towards a BDC position, at 602. During the intake stroke, an intake valve at least partially opens at 604 to admit a fluid into the cylinder. The intake valve closes at 606 and the cylinder completes its intake stroke and begins compressing the fluid present therein by undergoing a compression stroke at 608, during which the piston moves from the BDC position towards the TDC position. When the fluid within the cylinder has been sufficiently compressed or, alternatively, when the piston has reached a predetermined position within the cylinder, a transfer valve opens to allow the compressed charge to exit the cylinder at 610. The compressed charge exiting the cylinder is collected in a transfer manifold at 612. When the piston within the cylinder has reached another predetermined position, compressed charge from the transfer manifold is admitted into the cylinder through a combustion valve at 614. The combustion valve may be the same or different than the transfer valve, as previously discussed. Further, the compressed charge may be provided from the same or a different transfer manifold, as also previously discussed.

While the compressed charge is entering the cylinder, fuel is provided to the cylinder in mixing relation with the incoming compressed charge at 616. The cylinder undergoes a combustion stroke at 618 and an exhaust stroke at 620, during which the exhaust valve may be partially open to allow a portion or the entire exhaust gas content of the cylinder to exit the cylinder into the exhaust manifold. Optionally, this process may be repeated continuously at each engine cylinder during engine operation.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. An internal combustion engine, comprising:

a cylinder case forming a cylinder bore, the cylinder bore having a piston reciprocally disposed therewithin and moveable between top dead center (TDC) and bottom dead center (BDC) positions, the piston being connected to a rotatable crankshaft such that a position of the piston within the cylinder bore is related to a crank shaft angle;

a cylinder head disposed to cover an open end of the cylinder bore such that a variable volume is defined within the cylinder bore between the cylinder head and the piston;

an intake manifold being fluidly connectable with the variable volume through an intake valve;

an exhaust manifold being fluidly connectable with the variable volume through an exhaust valve;

a transfer manifold being fluidly connectable with the variable volume via a transfer conduit and through a transfer valve, the transfer manifold further being fluidly connectable with the variable volume via a combustion conduit through a combustion valve;

a fuel injector associated with the variable volume and adapted to provide a predetermined amount of fuel into the variable volume; and a valve activation mechanism configured to selectively open and close each of the intake, exhaust, transfer and combustion valves, such that:

the intake valve opens when the piston undergoes an intake stroke as it moves from the TDC position towards the BDC position to fill the variable volume with fluid from the intake manifold;

the variable volume is closed when the piston undergoes a compression stroke as it moves from the BDC position towards the TDC position to compress fluid present therein and yield a compressed charge;

the transfer valve opens to provide the compressed charge to the transfer manifold, where the compressed charge is collected;

the combustion valve opens to admit a compressed charge from the transfer manifold into the variable volume;

the variable volume is closed when the piston undergoes a combustion stroke as it moves from the TDC position towards the BDC position to combust a fluid/air mixture present therein; and the exhaust valve opens when the piston undergoes an exhaust stroke as it moves from the BDC position towards the TDC position to evacuate the variable volume from at least a portion of exhaust gas that is present therein.

2. The internal combustion engine of claim 1, wherein the fuel injector is associated with the combustion conduit and adapted to provide the predetermined amount of fuel in mixing relation with the compressed charge passing through the combustion conduit and entering the variable volume when the combustion valve is open.

3. The internal combustion engine of claim 1, wherein the cylinder case forms a plurality of cylinder bores defining a plurality of variable volumes, each of the plurality of variable volumes being selectively fluidly connectable with the transfer manifold via respective transfer and combustion valves.

4. The internal combustion engine of claim 1, wherein the cylinder case forms an additional cylinder bore containing an additional piston that forms an additional variable volume with the cylinder head, the additional variable volume being fluidly connectable with the transfer manifold through an additional transfer conduit and an additional combustion conduit, the additional transfer conduit having an additional transfer valve and the additional combustion conduit having an additional combustion valve associated therewith.

5. The internal combustion engine of claim 4, wherein the valve activation mechanism is further configured such that when the piston undergoes the intake and combustion strokes, the additional piston undergoes corresponding combustion and exhaust strokes.

6. The internal combustion engine of claim 4, wherein the transfer manifold includes first and second separate volumes.

7. The internal combustion engine of claim 6, wherein the first and second separate volumes are formed in different engine components.

8. The internal combustion engine of claim 6, wherein the variable volume defined partially by the piston is connected to the first separate volume through the transfer conduit and to the second separate volume through the combustion conduit.

9. The internal combustion engine of claim 6, wherein the additional variable volume defined partially by the additional piston is connected to the second separate volume via the additional transfer conduit and to the first separate volume through the additional combustion conduit.

10. The internal combustion engine of claim 1, wherein the valve activation mechanism includes a camshaft rotatably disposed in the engine, the camshaft having lobes formed thereon configured to activate valve lifters associated with each of the intake, exhaust, transfer and combustion valves, and wherein the camshaft is arranged to rotate ¼ of a rotation for every full rotation of the crankshaft.

11. An internal combustion engine having first and second pluralities of cylinders, comprising:

a cylinder case forming first and second pluralities of cylinder bores, each cylinder bore having a piston reciprocally disposed therewithin and moveable between top dead center (TDC) and bottom dead center (BDC) positions, each piston being connected to a rotatable crankshaft such that a position of each piston within a respective cylinder bore is related to a crank shaft angle;

a cylinder head disposed to cover an open end of the cylinder bores such that first and second pluralities of variable volumes are defined within each respective cylinder bore, the cylinder head, and the respective piston;

an intake manifold being fluidly connectable with the first and second pluralities of variable volumes through a respective intake valve for each variable volume;

an exhaust manifold being fluidly connectable with the first and second pluralities of variable volumes through a respective exhaust valve for each variable volume;

a first transfer manifold being fluidly connectable with the first plurality of variable volumes via a respective transfer conduit and a respective transfer valve, and being further fluidly connectable with the second plurality of variable volumes via a respective combustion conduit and a respective combustion valve;

a second transfer manifold being fluidly connectable with the second plurality of variable volumes via a respective transfer conduit and a respective transfer valve, and being further fluidly connectable with the first plurality of variable volumes via a respective combustion conduit and a respective combustion valve;

a fuel injector associated with each of the combustion conduits of the first and second pluralities of variable volumes, the fuel injector being adapted to provide a predetermined amount of fuel into each variable volume; and a valve activation mechanism configured to selectively open and close each of the intake, exhaust, transfer and combustion valves, of each of the first and second pluralities of variable volumes, such that:

the intake valve of one of the first plurality of variable volumes opens when the respective piston undergoes an intake stroke as it moves from the respective TDC position towards the BDC position to fill the one of the first plurality of variable volumes with fluid from the intake manifold;

the intake valve corresponding to the one of the first plurality of variable volumes is closed when the piston undergoes a compression stroke as it moves from the respective BDC position towards the TDC position to compress fluid present therein and yield a compressed charge;

the transfer valve corresponding to the one of the first plurality of variable volumes opens to provide the compressed charge to the first transfer manifold, where the compressed charge is collected;

the combustion valve corresponding to the one of the first plurality of variable volumes opens to admit a compressed charge from the second transfer manifold into the one of the first plurality of variable volumes;

the combustion valve corresponding to the one of the first plurality of variable volumes is closed when the respective piston undergoes a combustion stroke as it moves from the respective TDC position towards the BDC position to combust a fluid/air mixture present therein; and the exhaust valve corresponding to the one of the first plurality of variable volumes opens when the respective piston undergoes an exhaust stroke as it moves from the BDC position towards the TDC position to evacuate the one of the first plurality of variable volumes from at least a portion of exhaust gas that is present therein.

12. The internal combustion engine of claim 11, wherein the valve activation mechanism is further configured such that:

the intake valve of one of the second plurality of variable volumes opens when the respective piston undergoes an intake stroke as it moves from the respective TDC position towards the BDC position to fill the one of the second plurality of variable volumes with fluid from the intake manifold;

the intake valve corresponding to the one of the second plurality of variable volumes is closed when the piston undergoes a compression stroke as it moves from the respective BDC position towards the TDC position to compress fluid present therein and yield a compressed charge;

the transfer valve corresponding to the one of the second plurality of variable volumes opens to provide the compressed charge to the second transfer manifold, where the compressed charge is collected;

the combustion valve corresponding to the one of the second plurality of variable volumes opens to admit a compressed charge from the first transfer manifold into the one of the second plurality of variable volumes;

the combustion valve corresponding to the one of the second plurality of variable volumes is closed when the respective piston undergoes a combustion stroke as it moves from the respective TDC position towards the BDC position to combust a fluid/air mixture present therein; and the exhaust valve corresponding to the one of the second plurality of variable volumes opens when the respective piston undergoes an exhaust stroke as it moves from the BDC position towards the TDC position to evacuate the one of the second plurality of variable volumes from at least a portion of exhaust gas that is present therein.

13. The internal combustion engine of claim 12, wherein the valve activation mechanism is further configured such that, when one of the first plurality of variable volumes undergoes the intake and compression strokes, one of the second plurality of variable volumes undergoes the combustion and exhaust strokes.

14. The internal combustion engine of claim 13, wherein a completion of the compression stroke of the one of the first plurality of variable volumes and an initiation of the combustion stroke of the one of the second plurality of variable volumes overlap.

15. The internal combustion engine of claim 11, wherein each fuel injector is adapted to provide the predetermined amount of fuel in mixing relation with the compressed charge passing through the respective combustion conduit and entering the respective variable volume.

16. The internal combustion engine of claim 11, wherein the first and second transfer manifolds are formed as a single engine component.

17. The internal combustion engine of claim 11, wherein the valve activation mechanism includes a camshaft rotatably disposed in the engine, the camshaft having lobes formed thereon configured to activate valve lifters associated with each of the intake, exhaust, transfer and combustion valves, and wherein the camshaft is arranged to rotate ¼ of a rotation for every full rotation of the crankshaft.

18. A method for operating an internal combustion engine, comprising:

at least partially opening an intake valve during an intake stroke of a cylinder, the cylinder defining a variable volume as a piston moves from a top dead center (TDC) position towards a bottom dead center (BDC) position;

closing the intake valve to fluidly isolate an air charge within the variable volume;

performing a compression stroke during which the piston moves from the BDC position towards the TDC position such that the air charge becomes a compressed air charge;

at least partially opening a transfer valve at a predetermined piston position within the cylinder to release the compressed charge from the variable volume and into a transfer manifold;

collecting one or more compressed air charges in the transfer manifold;

opening a combustion valve to admit a compressed charge into the variable volume from the transfer manifold;

providing a predetermined amount of fuel in mixing relation with the compressed charge entering the variable volume;

closing the combustion valve;

performing a combustion stroke of the cylinder; and performing an exhaust stroke of the cylinder, during which an exhaust valve at least partially opens to release at least a portion of exhaust gas present in the variable volume into an exhaust manifold.

19. The method of claim 18, wherein the transfer valve and the combustion valve are the same valve.

20. The method of claim 18, further comprising performing a dead expansion stroke and a dead compression stroke between the compression stroke and the combustion stroke.

21. The method of claim 18, wherein opening and closing of the intake, exhaust, transfer and combustion valves is accomplished by use of a cam-follower structural arrangement that includes a camshaft configured to rotate at ¼ of a rate of rotation of a crankshaft, which is associated with the piston.

22. The method of claim 18, further comprising an additional cylinder configured to undergo a respective combustion stroke that at least partially overlaps the compression stroke of the cylinder.

* * * * *